US010612167B2

(12) United States Patent
Harris et al.

(10) Patent No.: US 10,612,167 B2
(45) Date of Patent: Apr. 7, 2020

(54) MATERIAL BLEND WITH PATTERNED FABRIC

(71) Applicants: Daniel Harris, Commerce, CA (US); Marco DeGeorge, Commerce, CA (US)

(72) Inventors: Daniel Harris, Commerce, CA (US); Marco DeGeorge, Commerce, CA (US)

(73) Assignee: Alo, LLC, Commerce, CA (US)

( * ) Notice: Subject to any disclaimer, the term of this patent is extended or adjusted under 35 U.S.C. 154(b) by 203 days.

(21) Appl. No.: 15/633,535

(22) Filed: Jun. 26, 2017

(65) Prior Publication Data

US 2018/0119321 A1 May 3, 2018

Related U.S. Application Data

(60) Provisional application No. 62/416,092, filed on Nov. 1, 2016.

(51) Int. Cl.

| | |
|---|---|
| ***D04B 1/00*** | (2006.01) |
| ***D04B 1/12*** | (2006.01) |
| ***D01F 6/62*** | (2006.01) |
| ***D06B 11/00*** | (2006.01) |
| ***D01D 5/00*** | (2006.01) |
| ***D02G 3/04*** | (2006.01) |

(Continued)

(52) U.S. Cl.

CPC ..... *D04B 1/126* (2013.01); *D01D 5/00* (2013.01); *D01F 6/62* (2013.01); *D02G 3/04* (2013.01); *D04B 39/00* (2013.01); *D06B 1/00* (2013.01); *D06B 11/002* (2013.01); *D06B 11/0056* (2013.01); *D01F 1/06* (2013.01)

(58) Field of Classification Search

CPC . D04B 1/126; D04B 7/26; D04B 9/28; D04B 7/24; D04B 35/10; D04B 39/00; D04B 1/16; D01D 5/00; D01F 6/62; D01F 1/06; D02G 3/04; D06B 1/00; D06B 11/0056

See application file for complete search history.

(56) References Cited

U.S. PATENT DOCUMENTS 3,795,569 A 3/1974 Piller et al.
5,477,595 A * 12/1995 Weingarten ..... A41B 1/00 28/100

(Continued)

OTHER PUBLICATIONS

International Search Report, dated Mar. 6, 2018 from PCT Application No. PCT/US2017-059313.

*Primary Examiner* — Eisa B Elhilo

(74) *Attorney, Agent, or Firm* — Rutan & Tucker LLP

(57) ABSTRACT

A blended fabric having a patterned color includes a first portion comprised of cotton and a second portion comprised of polyester. A dye that has a strong affinity for cotton and a slight affinity for polyester is applied to the fabric. The dye gives the cotton portion a deep black color and applies a light gray color to the polyester portion. A combination of deep black cotton and light gray polyester combines to provide the patterned color of the blended fabric. The blended fabric may be comprised of a larger percentage of cotton than polyester that is spun into a single filament yarn that is then knitted into a Jersey Knit styled fabric, a looped knit terry fabric, or a fleece fabric. Further, the present invention comprises a blended fabric whereby dye absorption by the cotton and not by the polyester create darker and lighter patterns within the blended fabric.

23 Claims, 1 Drawing Sheet

(51) Int. Cl.

| | |
|---|---|
| ***D04B 39/00*** | (2006.01) |
| ***D06B 1/00*** | (2006.01) |
| *D01F 1/06* | (2006.01) |

(56) References Cited

U.S. PATENT DOCUMENTS

| | | | | |
|---|---|---|---|---|
| 8,182,550 | B1 | 5/2012 | Hayes | |
| 2002/0066145 | A1* | 6/2002 | Gupta | D06P 1/5257 8/478 |
| 2004/0142615 | A1 | 7/2004 | Hatch et al. | |
| 2006/0010929 | A1 | 1/2006 | Chuang et al. | |
| 2007/0006400 | A1 | 1/2007 | Brown et al. | |
| 2017/0314168 | A1 | 11/2017 | Schoots et al. | |

* cited by examiner

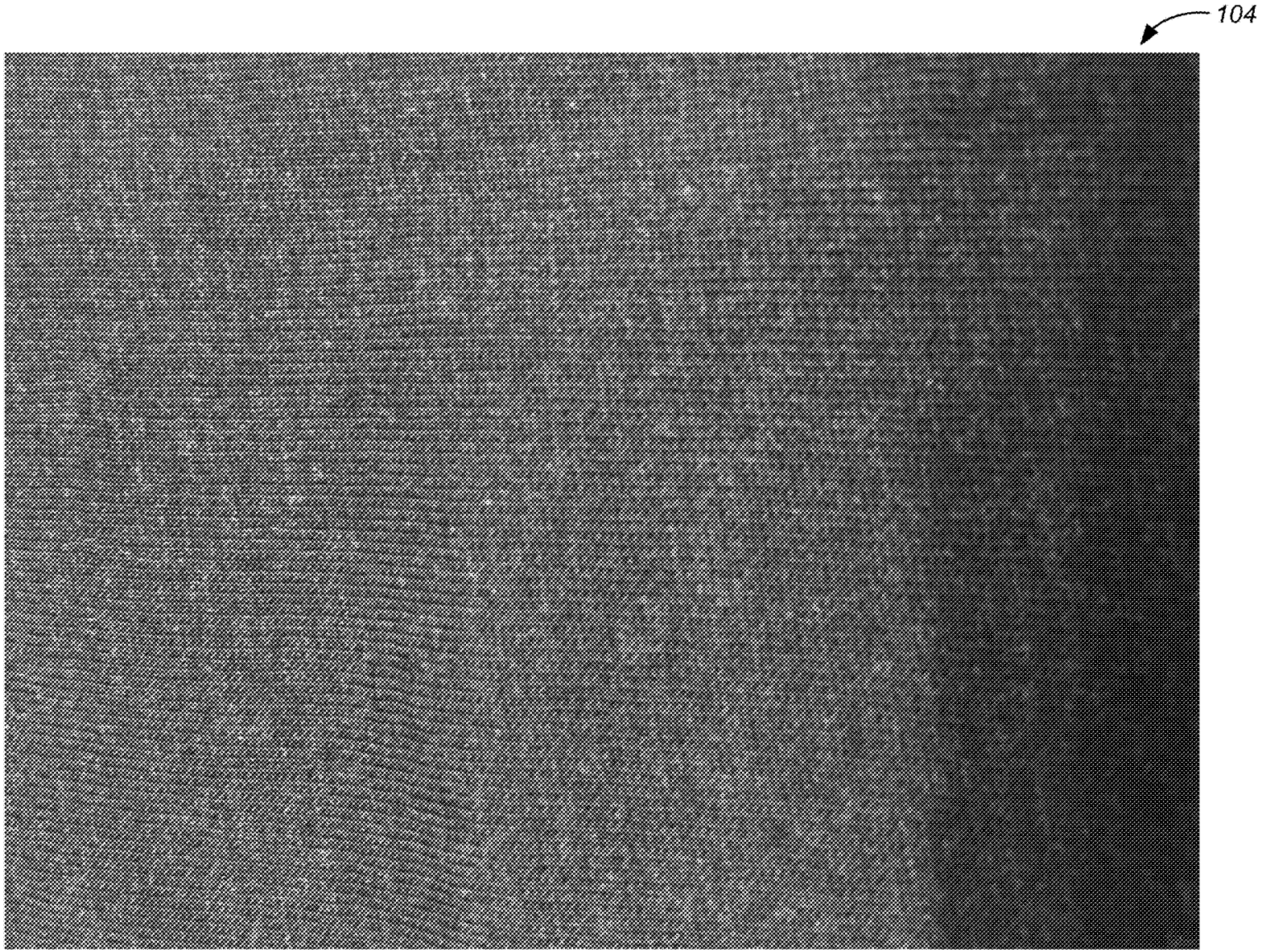
104

MATERIAL BLEND WITH PATTERNED FABRIC

PRIORITY

This application claims the benefit of, and priority to, U.S. Provisional Application No. 62/416,092, titled "Material Blend With Patterned Weave," filed Nov. 1, 2016, which is incorporated by reference in its entirety into the application.

FIELD

The field of the present disclosure generally relates to dyeing woven and/or knit fabrics. More particularly, the field of the invention relates to an apparatus and a method for a cotton/polyester blended fabric comprising a dye having a strong affinity for the cotton and a relatively slight affinity for the polyester to provide a unique color and pattern of the cotton/polyester blend that increases creative options for garment designers.

BACKGROUND

Blends of cotton and polyester fibers are important textiles used in the manufacture of clothing and other textile products. As is well known, the dyes and process conditions used to color cotton are different than the dyes and processes used to dye polyester fibers.

Cotton fibers may be dyed using fiber reactive dyes of the vinyl sulfone, dichloroquinoxalone, halotriazine, and halopyrimidine types. The fiber reactive dyes may be applied to the fiber under alkaline conditions at a temperature ranging from about 40° to 110° C. in an aqueous solution containing an electrolyte which promotes exhausting the dye from the dye bath to the fiber. These dyes form a covalent chemical bond with the hydroxy groups of the cotton and exhibit excellent fastness properties. The fiber reactive dyes are also hydrophilic, have a high degree of affinity for cellulosic cotton fibers and are stable under alkaline pH conditions.

Polyester fibers are hydrophobic and generally may be dyed with disperse dyes which are also hydrophobic. The disperse dyes are sparingly soluble in water and typically may be dispersed in water with the aid of a dispersing agent, generally a surfactant in combination with other auxiliaries. Disperse dyes color the polyester fiber by diffusion into the fiber under the influence of heat and dyeing auxiliaries. Unfortunately, disperse dyes are generally not stable at higher pH and are normally applied at pH 5-7 at a temperature of 120°–140° C. Additionally, the disperse dye dispersion can be sensitive to electrolytes which tend to cause dispersion instability.

As will be appreciated, however, the polyester fibers comprising a cotton/polyester blend may have a slight affinity for fiber reactive dyes that are applied to the cotton, thereby giving rise to a wide variety of resultant color mixtures or patterns of the cotton/polyester blend whereby the reactive dyes may have very low affinity to the polyester thereby creating a distinct pattern by way of the dye and the fiber blended yarn.

SUMMARY

An apparatus and method are provided for a blended fabric having a desired patterned color. In one embodiment, the blended fabric includes a first portion comprised of cotton and a second portion comprised of polyester. The blended fabric may include a first portion comprised of cotton and a second portion comprised of polyester. In one embodiment, the first portion comprises substantially 90% of the blended fabric, and the second portion comprises substantially 10% of the blended fabric. A dye that has a strong affinity for the cotton and a relatively slight affinity for the polyester is applied to the blended fabric. The dye gives the cotton portion of the yarn a deep black color and applies a light gray color to the polyester portion of the yarn. A combination of deep black cotton and light gray polyester combine to provide the patterned color of the blended fabric.

In an exemplary embodiment, a blended fabric having a patterned color comprises a first portion comprised of cotton; a second portion comprised of polyester; and a dye that has a strong affinity for the cotton and a relatively slight affinity for the polyester.

In another exemplary embodiment, the dye imparts a shade to the polyester that is lighter than a shade applied to the cotton. In another exemplary embodiment, the dye gives the cotton portion of the blended fabric a deep black color and applies a light gray color to the polyester portion of the fabric. In another exemplary embodiment, the combination of deep black cotton and light gray polyester combine to provide the patterned color of the blended fabric.

In another exemplary embodiment, the blended fabric is comprised of a Jersey Knit style fabric. In another exemplary embodiment, the blended fabric is comprised of a looped knit terry style fabric. In another exemplary embodiment, the blended fabric is comprised of and of a Jersey knit fabric, a loop terry fabric, a fleece fabric, and a rib fabric. In another exemplary embodiment, the blended fabric comprises a weight ranging between substantially 3 ounces/yd$^2$ and substantially 12 ounces/yd$^2$. In another exemplary embodiment, the blended fabric has a weight that is a function of the size of a yarn comprising the blended fabric, the size of the yarn ranging between 16-single to 50-single. In another exemplary embodiment, the blended fabric is comprised of two differently-sized yarns that are mixed together so as to achieve various desired weights of the blended fabric. In another exemplary embodiment, the first portion comprises substantially 90% of the blended fabric, and the second portion comprises substantially 10% of the blended fabric.

In an exemplary embodiment, a method for a fabric having a desired patterned color comprises spinning a single filament yarn comprised of cotton and polyester; applying a black reactive dye to the single filament yarn; and knitting the single filament yarn into the fabric.

In another exemplary embodiment, spinning comprises combining a first portion of the cotton and a second portion of the polyester to form the single filament yarn. In another exemplary embodiment, the first portion comprises substantially 90% of the single filament yarn, and the second portion comprises substantially 10% of the single filament yarn.

In another exemplary embodiment, applying comprises allowing the black reactive dye to be absorbed by the cotton and substantially unabsorbed by the polyester to form the desired patterned color. In another exemplary embodiment, knitting comprises forming any of a looped knit terry fabric, or a fleece fabric. In another exemplary embodiment, knitting comprises forming the fabric to possess a weight ranging between substantially 3 ounces/yd$^2$ and substantially 12 ounces/yd$^2$.

In an exemplary embodiment, a method for a blended fabric comprises providing a first material and a second material; spinning the first material and the second material into a single filament yarn; knitting the single filament yarn into a fabric; and applying a black reactive dye to the fabric to form a dark-light pattern on the fabric.

In another exemplary embodiment, providing comprises obtaining the first material in the form of cotton, and obtaining the second material in the form of polyester. In another exemplary embodiment, spinning comprises forming the single filament yarn such that the first material comprises substantially 90% of the single filament yarn, and the second material comprises substantially 10% of the single filament yarn. In another exemplary embodiment, applying comprises allowing the black reactive dye to be absorbed by the first material and substantially unabsorbed by the second material, thereby forming the dark-light pattern of the Jersey style fabric. In another exemplary embodiment, knitting comprises forming a Jersey Knit style fabric.

In an exemplary embodiment, a method for applying a dark-light pattern to a blended Jersey Knit fabric comprises providing a quantity of cotton and a quantity of polyester; spinning the cotton and the polyester into a single filament yarn comprising substantially 90% cotton and substantially 10% polyester; knitting the single filament yarn into the blended Jersey Knit fabric; and applying a black reactive dye to impart the dark-light pattern to the blended Jersey Knit fabric. In another exemplary embodiment, applying comprises allowing the black reactive dye to be absorbed by the cotton and substantially unabsorbed by the polyester so as to form the dark-light pattern of the blended Jersey Knit fabric.

BRIEF DESCRIPTION OF THE DRAWINGS

The drawings refer to embodiments of the present disclosure in which:

FIG. 1 illustrates an exemplary embodiment of a knit fabric comprised of a cotton/polyester blend that is dyed in accordance with the present disclosure.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first material," may be made. However, the specific numeric reference should not be interpreted as a literal sequential order but rather interpreted that the "first material" is different than a "second material." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure provides a blended fabric having a desired patterned color. The blended fabric includes a first portion comprised of cotton and a second portion comprised of polyester. A dye that has a strong affinity for the cotton and a relatively slight affinity for the polyester may be applied to the blended fabric. The dye gives the cotton portion a deep black color and applies a light gray color to the polyester portion of the fabric. A combination of deep black cotton and light gray polyester combines to provide the patterned color of the blended fabric. The blended fabric may be comprised of a larger percentage of cotton than polyester that is spun into a single filament yarn that is then knitted into any of a looped knit terry fabric, a Jersey Knit styled fabric, or a fleece fabric. The dye absorption by the cotton and the lack of dye absorption of the polyester create darker and lighter patterns within the blended fabric.

FIG. 1 illustrates an exemplary embodiment of a cotton/polyester blended fabric that is dyed in accordance with the present disclosure. In some embodiments, the blended fabric may be a Jersey Knit style fabric, as is shown in FIG. 1, comprising a weight ranging between substantially 3 ounces/yd$^2$ and substantially 12 ounces/yd$^2$. In general, the weight of the blended fabric is a function of the yarn size, which may range between 16-single to 50-single. In some embodiments, the blended fabric may be comprised of any of various woven or knitted styles. For example, in some embodiments, the blended fabric may be either a looped knit terry fabric, or a fleece fabric. In some embodiments wherein the blended fabric comprises a fleece fabric, two differently-sized yarns may be mixed together so as to achieve various desired weights of the blended fabric. In some embodiments, the blended fabric preferably is comprised of a cotton and polyester spun blend yarn comprised of substantially 10% polyester and substantially 90% cotton. It is contemplated, however, that the spun blend yarn may be comprised of other natural and synthetic fibers, or blends thereof, as well as any of a wide variety of textured, synthetic multifilament yarns, without limitation.

In some embodiments, the yarns may be initially scoured in a continuous scour at a temperature ranging from about 180° F. to about 210° F. and then washed or rinsed in a series of hot and cold water baths to remove any natural oils, waxes and any additives from earlier opening, blending, carding or spinning operations. The yarns may then be dried prior to passing into a dye bath so that the percent of moisture is at or below normal again, such as, by way of non-limiting example, about 2% to about 5% for a polyester/cotton blended yarn. As will be appreciated, the dryness of the yarn aids in pulling the dye into the yarn. Further, keeping the dye bath at a temperature ranging from about 130° F. to about 190° F., it is possible to have the dye substantially penetrate the yarn or fiber bundle.

When a polyester/cotton blended yarn is dyed, as described herein with respect to FIG. 1, both the polyester and cotton portions may be penetrated and dyed. In general, the dye has a strong affinity for the cotton and a relatively slight affinity for the polyester. Although the polyester portion may be slightly penetrated by the dye, the resulting shade of the polyester portion will be much lighter than the shade of the cotton portion. In one embodiment, the dye gives the cotton portion of the yarn a deep black color and applies a light gray color to the polyester portion of the yarn. The combination of deep black cotton and light gray polyester combine to provide a unique color and pattern of the cotton/polyester blended fabric, as shown in FIG. 1.

In some embodiments, a dark-light pattern may be applied to a blended fabric in the form of any of a looped knit terry fabric, a Jersey Knit style fabric, or a fleece fabric. The blended fabric generally is comprised of a first material and a second material that may be spun into a single filament yarn. In some embodiments, the first material may be comprised of cotton, and the second material may be comprised of polyester. The first and second materials may be spun to form a single filament yarn comprising substantially 90% cotton and substantially 10% polyester. The single filament yarn may then be knitted into a fabric, such as a looped knit terry fabric, a Jersey Knit style fabric, or a fleece fabric. Black reactive dye may be applied to the fabric to apply the dark-light pattern to the fabric. As will be appreciated, the black reactive dye is well absorbed by the cotton and relatively unabsorbed by the polyester. The lack of dye absorption by the polyester and the strong affinity for the dye by the cotton cooperate to give the blended fabric a desired dark-light pattern.

In one exemplary method, a dark-light pattern may be applied to a blended Jersey Knit fabric. The blended Jersey Knit fabric may be comprised of a knitted single filament yarn. The single filament yarn is formed by spinning cotton and polyester, such that the single filament yarn is comprised of substantially 90% cotton and substantially 10% polyester. A black reactive dye may be applied to the blended Jersey Knit fabric. Allowing the black reactive dye to be absorbed by the cotton and substantially unabsorbed by the polyester cooperates to impart the dark-light pattern of the blended Jersey Knit fabric.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A blended fabric having a patterned color, comprising:
a first portion comprised of cotton;
a second portion comprised of polyester; and
a dye that has a strong affinity for the cotton and a relatively slight affinity for the polyester,
wherein the blended fabric is comprised of two differently-sized yarns that are mixed together so as to achieve various desired weights of the blended fabric.

2. The fabric of claim 1, wherein the dye imparts a shade to the polyester that is lighter than a shade applied to the cotton.

3. The fabric of claim 1, wherein the dye gives the first portion of the blended fabric a deep black color and applies a light gray color to the second portion of the fabric.

4. The fabric of claim 3, wherein the combination of the first portion and the second portion combine to provide the patterned color of the blended fabric.

5. The fabric of claim 1, wherein the blended fabric is comprised of a Jersey Knit style fabric.

6. The fabric of claim 1, wherein the blended fabric is comprised of a looped knit terry style fabric.

7. The fabric of claim 1, wherein the blended fabric is comprised of a Jersey Knit fabric, a loop terry fabric, a fleece fabric, and a rib fabric.

8. The fabric of claim 1, wherein the blended fabric comprises a weight ranging between 3 ounces/yd$^2$ and 12 ounces/yd$^2$.

9. The fabric of claim 1, wherein the blended fabric has a weight that is a function of the size of a yarn comprising the blended fabric, the size of the yarn ranging between 16-single to 50-single.

10. The fabric of claim 1, wherein the first portion comprises 90% of the blended fabric, and the second portion comprises 10% of the blended fabric.

11. A method for a fabric having a desired patterned color, comprising:
spinning a single filament yarn comprised of cotton and polyester;
applying a black reactive dye to the single filament yarn; and
knitting the single filament yarn into the fabric.

12. The method of claim 11, wherein spinning comprises combining a first portion of the cotton and a second portion of the polyester to form the single filament yarn.

13. The method of claim 12, wherein the first portion comprises 90% of the single filament yarn, and the second portion comprises 10% of the single filament yarn.

14. The method of claim 11, wherein applying a black reactive dye to the single filament yarn comprises the black reactive dye to be absorbed by the cotton and unabsorbed by the polyester to form the desired patterned color.

15. The method of claim 11, wherein knitting comprises forming any of a looped knit terry fabric, or a fleece fabric.

16. The method of claim 11, wherein knitting comprises forming the fabric to possess a weight ranging between 3 ounces/yd$^2$ and 12 ounces/yd$^2$.

17. A method for a blended fabric, comprising:
providing a first material and a second material;
spinning the first material and the second material into a single filament yarn;
knitting the single filament yarn into a fabric; and
applying a black reactive dye to the fabric to form a dark-light pattern on the fabric.

18. The method of claim 17, wherein the first material includes a form of cotton, and the second material includes a form of polyester.

19. The method of claim 18, wherein the single filament yarn includes 90% of the first material, and 10% of the second material.

20. The method of claim 17, wherein applying a black reactive dye to the fabric comprises the black reactive dye to be absorbed by the first material and unabsorbed by the second material, thereby forming the dark-light pattern of a Jersey Knit style fabric.

21. The method of claim 17, wherein knitting comprises forming a Jersey Knit style fabric.

22. A method for applying a dark-light pattern to a blended Jersey Knit fabric, comprising:
providing a quantity of cotton and a quantity of polyester;
spinning the cotton and the polyester into a single filament yarn comprising 90% cotton and 10% polyester;

knitting the single filament yarn into the blended Jersey Knit fabric; and applying a black reactive dye to impart the dark-light pattern to the blended Jersey Knit fabric.

23. The method of claim 22, wherein applying a black reactive dye comprises the black reactive dye to be absorbed by the cotton and unabsorbed by the polyester so as to form the dark-light pattern of the blended Jersey Knit fabric.

* * * * *